US007604464B2

(12) United States Patent
Williams

(10) Patent No.: US 7,604,464 B2
(45) Date of Patent: Oct. 20, 2009

(54) MECHANICALLY ACTUATED GAS SEPARATOR FOR DOWNHOLE PUMP

(75) Inventor: Benny J. Williams, Godley, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 608 days.

(21) Appl. No.: 11/187,536

(22) Filed: Jul. 22, 2005

(65) Prior Publication Data

US 2006/0002808 A1 Jan. 5, 2006

Related U.S. Application Data

(62) Division of application No. 10/447,050, filed on May 28, 2003, now Pat. No. 6,945,762.

(60) Provisional application No. 60/383,537, filed on May 28, 2002.

(51) Int. Cl.
*F04B 47/00* (2006.01)

(52) U.S. Cl. ..... 417/448

(58) Field of Classification Search ..... 166/105.5; 417/53, 546, 547, 554, 555.1, 555.2
See application file for complete search history.

(56) References Cited

U.S. PATENT DOCUMENTS 1,698,444 A * 1/1929 Lybyer ..... 166/105.4
4,425,083 A 1/1984 Peterson et al.
4,531,584 A 7/1985 Ward
4,676,308 A 6/1987 Chow et al.
RE33,163 E * 2/1990 Madden ..... 417/444
5,651,666 A 7/1997 Martin
5,653,286 A 8/1997 McCoy et al.
6,179,054 B1 1/2001 Stewart
6,196,312 B1 3/2001 Collins et al.
6,273,690 B1 8/2001 Fischer, Jr. et al.
6,322,616 B1 11/2001 Kennedy et al.
6,537,042 B1 3/2003 Lundback

OTHER PUBLICATIONS

Baker Hughes, www.bakerhughes.com. web page, Centrilift Submersible Pumping Systems, 2 pages, 2001.
Baker Hughes, www.bakerhughes.com web page, Centrilift System Application, 5 pages, 2001.

* cited by examiner

*Primary Examiner*—Devon C Kramer
*Assistant Examiner*—Bryan Lettman
(74) *Attorney, Agent, or Firm*—Geoffrey A. Mantooth

(57) ABSTRACT

A reciprocating downhole pump has a gas separator located at its bottom end. The separator forms a chamber that is expanded and contracted when the pump is reciprocated. Expansion and contraction of the chamber occurs by either the plunger reciprocating in the chamber or a piston coupled to the plunger reciprocating in the chamber. The chamber has an orifice therein so that during reciprocation fluid flows in and out of the orifice. The orifice is sized so as to subject the fluid to a pressure drop, wherein gas in the fluid is separated from the liquid.

6 Claims, 8 Drawing Sheets

MECHANICALLY ACTUATED GAS SEPARATOR FOR DOWNHOLE PUMP

SPECIFICATION

This application is a divisional patent application of application Ser. No. 10/447,050, filed May 28, 2003, now U.S. Pat. No. 6,945,762, which application claimed the benefit of application Ser. No. 60/383,537, filed May 28, 2002.

FIELD OF THE INVENTION

The present invention relates to subsurface, or downhole, pumps, such as are used to pump oil and other fluids and bases from wells.

BACKGROUND OF THE INVENTION

When an oil well is first drilled and completed, the fluids (such as crude oil) may be under natural pressure that is sufficient to produce on its own. In other words, the oil rises to the surface without any assistance. In many oil wells, and particularly those in fields that are established and aging, natural pressure has declined to the point where the oil must be artificially lifted to the surface. Subsurface pumps are located in the well below the level of the oil. A string of sucker rods extends from the pump up to the surface to a pump jack device, beam pump unit or other devices. A prime mover, such as a gasoline or diesel engine, an electric motor or a gas engine, on the surface causes the pump jack to rock back and forth, thereby moving the string of sucker rods up and down inside of the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a chamber between the valves with fluid and then lifts the fluid up the tubing towards the surface.

One problem encountered in downhole pumps is that the chamber between the valves fails to fill completely with liquid. Instead, the chamber contains undissolved gas, air, or vacuum, which are collectively referred to herein as gas.

Such failure to completely fill the chamber is attributed to various causes. In a gas lock situation or a gas interference situation, the formation produces gas in addition to liquid. The gas is at the top of the chamber, while the liquid is at the bottom, creating a liquid-to-gas interface. If this interface is relatively high in the chamber, gas interference results. In gas interference, the plunger (on the downstroke) descends in the chamber and hits the liquid-to-gas interface. The change in resistances causes a mechanical shock or jarring. Such a shock damages the pump, the sucker rods and the tubing. In addition, a loss of pumping efficiency results.

If the liquid-to-gas interface is relatively low in the chamber, a gas lock results, wherein insufficient pressure is built up inside of the chamber on the downstroke to open the plunger valve. The plunger is thus not charged with fluid and the pump is unable to lift anything. A gas locked pump, and its associated sucker rods and tubing, may experience damage from the plunger hitting the interface.

I am a co-inventor of U.S. Pat. No. 6,273,690, which addresses the problem of gas in the compression chamber by allowing the gas to bleed off from the chamber. The pump has worked very well.

In some instances, however, the gas remains in solution with the liquid in the compression chamber. Thus, any attempts to bleed off the gas are frustrated by the lack of separation between the gas and liquid. Consequently, the gas either interferes with, or else if present in sufficient quantities, locks the pump.

In the prior art, there are several types of gas separators used in conjunction with sucker rod downhole pumps. One type of prior art separator uses a dip tube located at the bottom of the pump. Surrounding the dip tube is a mud anchor, with a bull plug at the bottom. The mud anchor forms a chamber around the dip tube. The mud anchor has perforations, wherein the fluid enters the chamber through the perforations and travels down where it then enters the dip tube. The distance between the mud anchor perforations and the entry to the dip tube is referred to as the quiet zone, which is typically 1.5-2 times the pump volume. The fluid temporarily resides in the quiet zone on the pump downstroke, allowing gas to bubble out and escape through the mud anchor perforations.

Another type of prior art separator utilizes a stationary rotor. Fluid is forced into the angled rotor vanes to rotate the fluid, wherein gas is separated from the fluid. The reciprocating action of the pump moves the fluid through the rotor.

SUMMARY OF INVENTION

It is an object of the present invention to provide a downhole pump that minimizes the effects of gas on the operation of the pump.

It is further object of the present invention to provide a downhole pump that separates gas from liquid.

The present invention provides a downhole pump that comprises a barrel and a plunger located inside of the barrel, with one of the plunger and the barrel reciprocating with respect to the other. There is a first one-way valve located in the plunger and a second one-way valve located in the barrel. A first compression chamber is located between the first and second one-way valves. A second chamber is formed between the plunger and the barrel below the first chamber. The second chamber is subjected to expansion and contraction due to the reciprocation between the plunger and the barrel. The second chamber has an orifice that creates a pressure drop for fluid passing through the orifice. The orifice is structured and arranged to draw formation fluid in and out. The plunger has an intake that is separate from the second chamber.

A downhole pump equipped with the separator utilizes the reciprocating action of the pump to move the fluid through the orifice. As the fluid passes through the orifice, the fluid is subjected to a pressure drop, wherein gas is separated from the liquid. The liquid is then drawn into the plunger through the intake.

In accordance with one aspect of the present invention, the downhole pump further comprises a piston located in the second chamber. The piston reciprocates in the second chamber so as to cause the expansion and contraction of the second chamber. The piston is coupled to the plunger.

In accordance with another aspect of the present invention, the downhole pump further comprises a third chamber located between the first and second chambers. The plunger intake is located in the third chamber.

In accordance with another aspect of the present invention, the intake extends through and out of the second chamber.

In accordance with another aspect of the present invention, the piston is double acting and there is one of the orifices on each side of the piston.

In accordance with another aspect of the present invention, the orifice comprises a removable insert.

In accordance with another aspect of the present invention, first and second one-way valves each have respective seats, with the respective seats having a respective inside diameter. The orifice is sized smaller than the inside diameters of the seats.

In accordance with another aspect of the present invention, there is provided a third one-way valve that allows fluid to flow into the second chamber through the orifice and a fourth one-way valve that allows fluid to flow out of the second chamber through the orifice.

The present invention also provides a separator for use with a downhole pump having a barrel and a plunger in the barrel, with one of the barrel and the plunger reciprocating with respect to the other. The separator comprises a first extension tube having upper and lower ends with the upper end structured and arranged to be coupled to a lower end of the pump barrel. The first extension tube is closed at the lower end. The first extension tube forms a chamber and has an orifice for allowing communication between the chamber and the exterior of the extension tube. There is a second extension tube having upper and lower ends with the upper end being structured and arranged to be coupled to a lower end of the plunger. The second extension tube has a piston coupled thereto and is located for reciprocation in the chamber. The second extension tube has an intake opening that is located outside of the chamber.

In accordance with one aspect of the present invention, the piston is double acting and there is one of the orifices on each side of the piston.

In accordance with another aspect of the present invention, the separator further comprises a second chamber located above the chamber, with the plunger intake being located in the second chamber.

In accordance with another aspect of the present invention, the intake extends through and out of the chamber.

In accordance with another aspect of the present invention, the orifice comprises a removable insert.

The present invention also provides a separator for use with the downhole pump having a barrel and a plunger in the barrel, with one of the barrel and the plunger reciprocating with respect to the other. The separator comprises a first extension tube having upper and lower ends with the upper end structured and arranged to be coupled to a lower end of the pump barrel. The first extension tube is closed at the lower end. The first extension tube forms a chamber. The first extension tube has an orifice for allowing communication between the chamber and he exterior of the extension tube. The chamber is structured and arranged to be in communication with the lower end of the plunger. There is also provided a second extension tube having upper and lower ends with the upper end structured and arranged to be coupled to a lower end of the plunger. The second extension tube has an intake opening that is located outside of the chamber.

The present invention also provides a downhole pump that pumps fluid in a well, with the fluid comprising liquid and gas. The pump comprises a barrel and a plunger located inside of the barrel, with one of the barrel or the plunger reciprocating with respect to the other. First and second one-way valves are located in the pump, with the compression located between the first and second valves. The first and second valves each have a respective valve seat that subjects fluid being pumped by the pump to a pressure drop. At least one orifice is sized so as to subject the fluid to a pressure drop that is greater than the pressure drop caused by the first and second valves so as to separate the gas from the liquid. The orifice has one side exposed to the fluid having gas contained in liquid and having the other side exposed to a cavity. The cavity experiences changes in pressure of the fluid therein due to the reciprocation of the one of the plunger or barrel. There is a vent that allows the separated gas to escape outside of the pump.

In accordance with one aspect of the present invention, the pump further comprises an extension coupled to a lower end of the barrel, with the orifice located in the extension.

In accordance with another aspect of the present invention, the orifice is located inline with an intake to the pump so that the fluid flows through the orifice before entering the intake.

In accordance with still another aspect of the present invention, the orifice is located adjacent to a path the fluid follows before entering an intake to the pump.

In accordance with still another aspect of the present invention, the pump further comprises an intake tube that communicates with the first and second valves. The orifice comprises an annulus around the intake tube.

The present invention provides a method of separating gas from liquid in fluid pumped by a downhole pump. One member of the pump is reciprocated with respect to another member. The fluid is passed, by way of the reciprocation, through an orifice into a chamber. The orifice is sized so as to subject the fluid to a larger pressure drop than the fluid would subjected to inside of the pump, so as to separate the gas from the liquid. The gas is vented at a location that is above the orifice. The liquid is allowed to enter the pump at a location that is below the orifice.

In accordance with one aspect of the present invention the step of passing the fluid, by the reciprocation, through an orifice in the chamber further comprises drawing in the fluid through the orifice in one stroke of the reciprocation and in a subsequent stroke of the reciprocation drawing the liquid in through the entry of the pump.

In accordance with still another aspect of the present invention the step of passing the fluid, by the reciprocation, through an orifice in the chamber further comprises the step of drawing in the fluid through the orifice, then expelling the fluid through the orifice.

DESCRIPTION OF THE PREFERRED EMBODIMENT

The downhole pump of the present invention incorporates a mechanically actuated gas separator which serves to separate the downhole fluids into liquid and gas phases. The downhole fluids may include crude oil, water, natural gas, etc. The separated gas is vented away from the pump while the liquid enters the pump for lifting to the surface. The gas separator utilizes the reciprocating action of the pump itself to provide the work necessary for the separation. Separation is achieved by causing the fluid to flow through an orifice such that the fluid is subjected to a pressure drop. The reciprocating action of the pump serves to move the fluid through the orifice.

Figure 1:
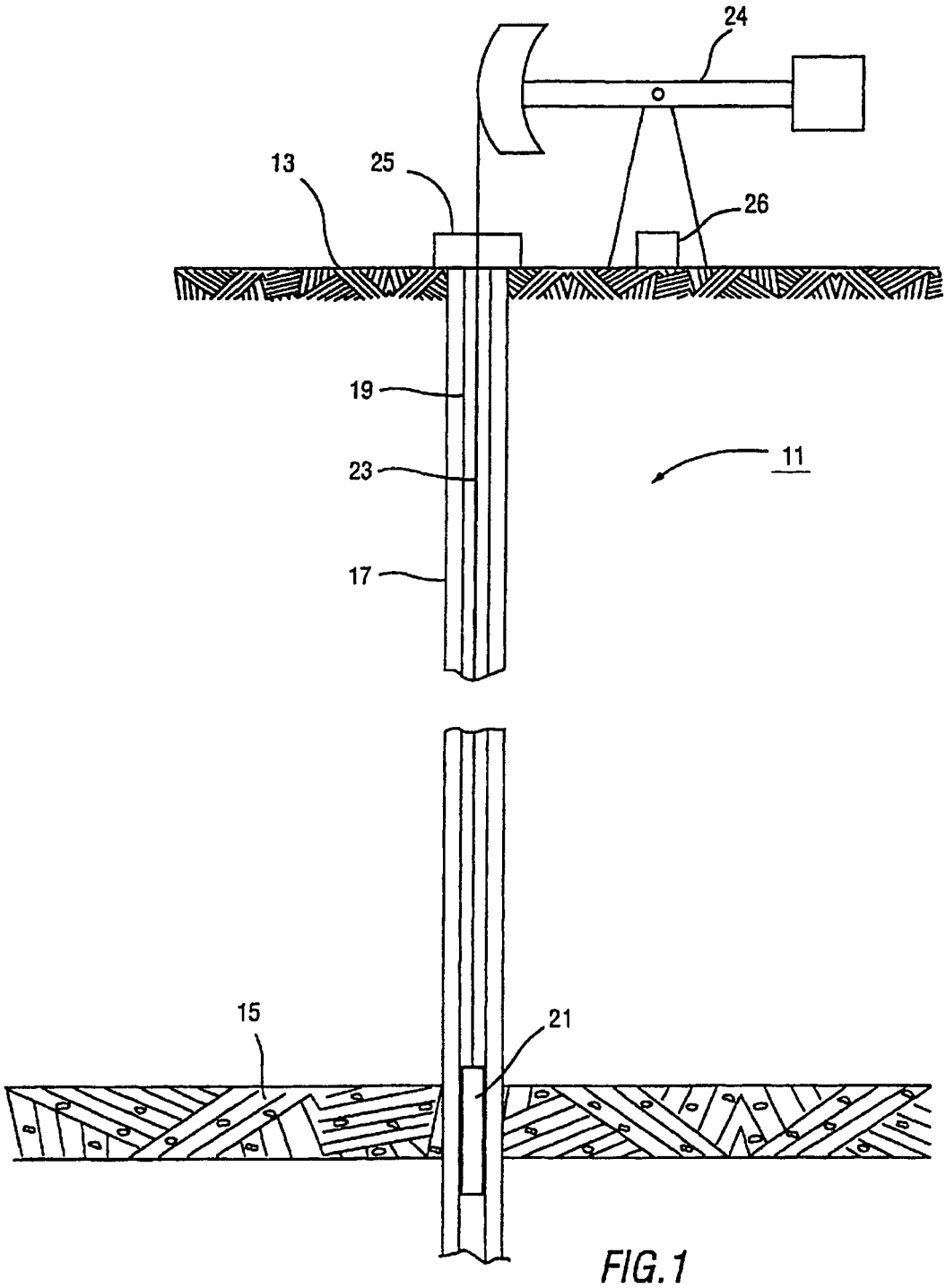
FIG. 1 is a schematic diagram of a well, shown with pumping equipment.

In FIG. 1, there is shown a schematic diagram of a producing oil well 11. The well has a borehole that extends from the surface 13 into the earth, past an oil-bearing formation 15.

The borehole has been completed and therefore has casing 17 which is perforated at the formation. A packer or other method (not shown) optionally isolates the formation 15 from the rest of the borehole. Tubing 19 extends inside of the casing from the formation 15 to the surface 13.

A subsurface pump 21 is located in the tubing 19 at or near the formation 15. A string of sucker rods 23 extends from the pump 21 up inside of the tubing 19 to a polished rod and a stuffing box 25 on the surface 13. The sucker rod string 23 is connected to a pump jack unit 24 which reciprocates up and down due to a prime mover 26, such as an electric motor, a gasoline or diesel engine, or a gas engine.

Figure 2A:
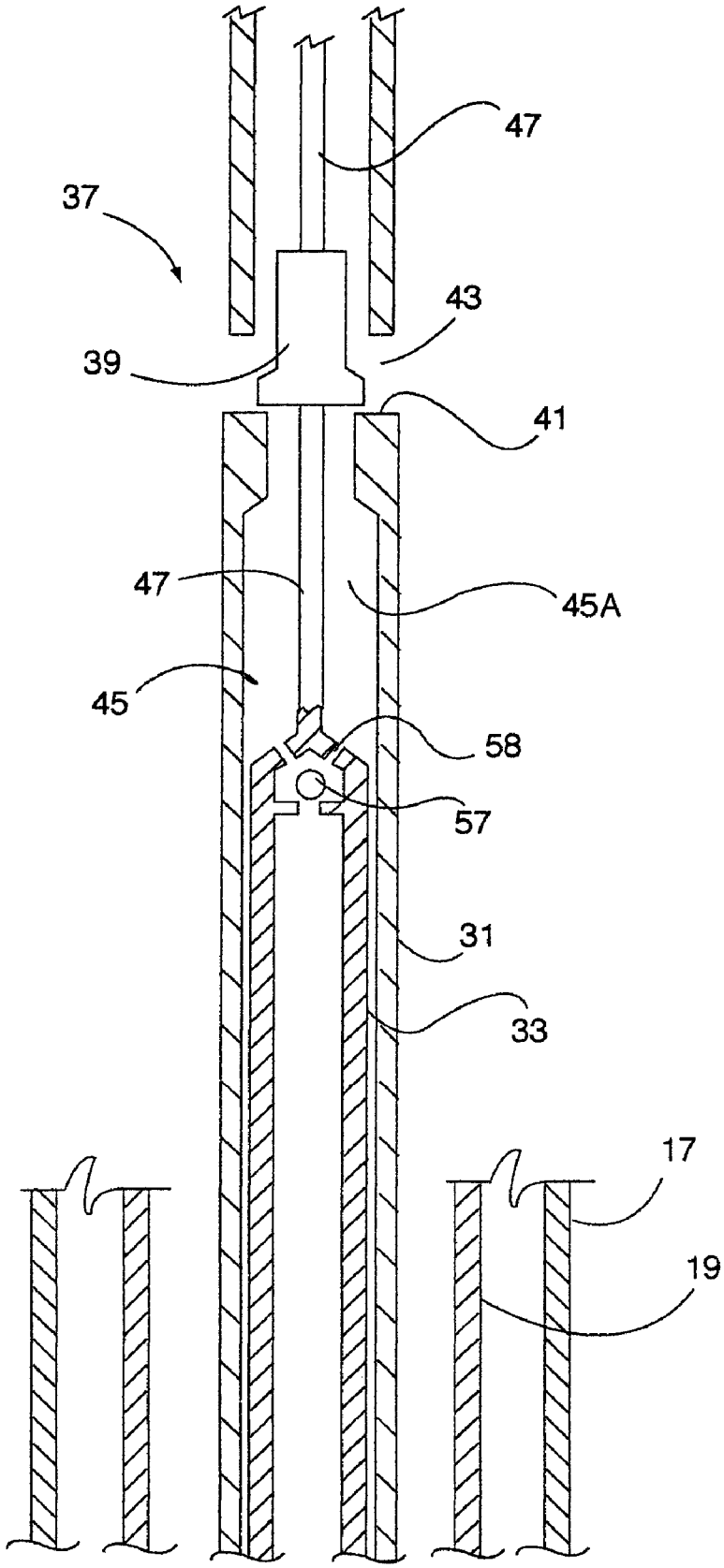
FIGS. 2A and 2B are longitudinal cross-sectional views of the downhole pump of the present invention, in accordance with a preferred embodiment, with FIG. 2A being the upper portion and FIG. 2B being the lower portion.
Figure 2B:
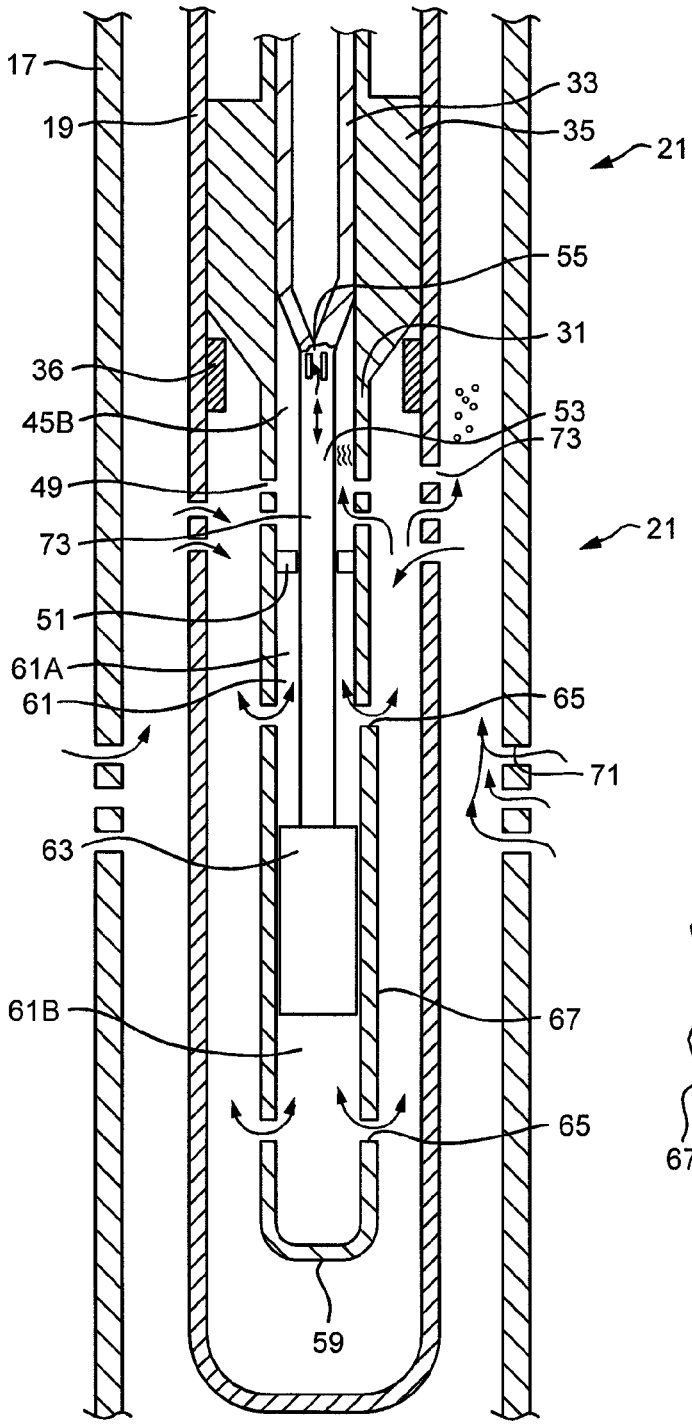

FIGS. 2A and 2B illustrate the pump 21 of the present invention, in accordance with a preferred embodiment. The pump 21 is of the insert type, where it is inserted into the tubing 19. In FIG. 2A, only a portion of the casing 17 and tubing 19 are shown.

The pumps described herein can be a top hold down or bottom hold down or some other type of pump. In addition, the pumps can be a tubing pump, wherein the pump is incorporated as part of the tubing string (specifically the barrel is part of the tubing string).

The pump 21 has a barrel 31 and a plunger 33 located inside of the barrel. The barrel and the plunger reciprocate relative to each other. In the embodiment shown, the barrel is fixed while the plunger reciprocates. The barrel 31 is inserted into the tubing 19 and secured with a hold down 35 and a seating nipple 36. The hold down 35 has packing to seal the barrel to the tubing. The invention can also be used on a pump with a fixed plunger and a traveling or reciprocating barrel.

The barrel 31 has an upper cage 37 (see FIG. 2A) for a sliding valve 39. The upper cage 37 has a seat 41 that receives the sliding valve 39. The cage 37 has openings 43 to allow communication with the inside of the tubing 19. Below the seat 41 is a chamber 45 for receiving the plunger 33. The plunger 33 can reciprocate up and down inside of the barrel chamber 45. The plunger 33 divides the chamber 45 into an upper chamber 45A and a lower chamber 45B. An upper rod 47 extends from the top of the plunger 33 through the seat 41 and the sliding valve 39. The rod 47 couples to the lower end of the sucker rods 23. The sliding valve 39 slides along the rod 47. Near the bottom of the lower chamber 45B (see FIG. 2B) are perforations 49 in the barrel 31 to allow fluid to flow inside. At the lower end of the lower chamber 45B is packing 51. A lower rod 53 depends from the plunger 33 through the packing 51. The packing 51 is fixed to the barrel 31 and allows the lower rod 53 to reciprocate therein. The lower rod 53 is coupled to the plunger 33 by way of a perforated cage 55. Thus, fluid can flow through the barrel perforations 49 into the cage 55 and into the plunger 33.

The plunger 33 has a one-way valve 57 (see FIG. 2A) therein. A preferred location for the valve is near the top of the plunger, although this need not be the case. The plunger 33 has perforations 58 or openings above the valve 57.

Figure 3:
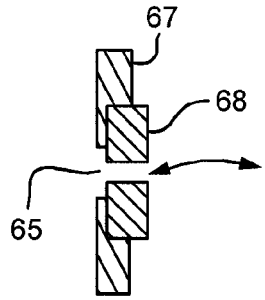
FIG. 3 is a detailed view of an orifice used in the pump.

The barrel 31 extends below the packing 51 for some distance. The lower end 59 of the barrel is closed. This lower extension of the barrel need not be the barrel itself, but can be an extension member of some type. The extension forms a lower chamber 61 below the packing 51. A piston 63 is located in the lower chamber 61, which piston is coupled to the lower rod 53. The piston reciprocates inside of the lower chamber 61. Thus, the lower chamber is divided by the piston into first and second lower chambers 61A, 61B. Each first and second lower chamber 61A, 61B has at least one, and perhaps several, orifices 65 through the barrel wall 67. FIG. 3 shows an orifice 65. The orifice 65 can have an insert 68 (see FIG. 3) to allow changing of the orifice size so as to suit the pump size and well conditions.

In operation, the plunger 33 is reciprocated up and down inside of the barrel by the sucker rods 33. As the plunger 33 reciprocates, so does the piston 63 inside of the lower chamber 61. Fluid from the formation flows through perforations 71 in the casing 17 and through perforations 73 in the tubing 19, which are located below the packing 35.

The fluid contains liquids such as oil and also contains gas. The gas may be in small bubbles and entrained in the fluid or the gas may be in solution with the liquid. The piston 63 and lower chamber 61 separate gas from liquid using pressure differentials.

On the downstroke, the plunger 33 and piston 63 descend. Fluid is drawn into the first lower chamber 61A through the respective orifices 65 and fluid is expelled from the second lower chamber 61B through the respective orifices 65. On the upstroke, fluid is expelled from the first lower chamber 61A and is drawn into the second lower chamber 61B through the respective orifices 65. The orifices 65 are sized so as to cause the fluid to experience a pressure drop, wherein gas is separated from liquid. Thus, with each pass through the orifice, the fluid undergoes some phase or gas separation. The piston 63 arrangement shown in FIG. 2B is double acting in that separation work is done on both the upstroke and the downstroke.

After the fluid is alternately expelled from the first and second lower chambers 61A, 61B, the gas rises and exits through the tubing perforations 73. The liquid also rises and enters the barrel 31 through the barrel perforations 49. The liquid enters the lower rod cage 55 and then enters the plunger 33.

On the downstroke, the sliding valve 39 (see FIG. 2A) is closed while the plunger valve 57 is open. The respective open and closed valve positions are determined by pressure differentials across the valves. As the plunger 33 descends, pressure above the sliding valve 39 is greater and so causes the sliding valve to close against the seat 41. The expanding upper chamber 45A creates a low pressure above the plunger valve 57. This opens the plunger valve 57 and the liquid passes through. On the upstroke, the rising plunger 33 compresses the upper chamber 45A, thereby closing the plunger valve 57 and lifting the fluid above the plunger valve. The pressure in the upper chamber 45A increases and opens the sliding valve 39. Fluid passes through the open sliding valve 39. The fluid exits the barrel through the perforations 43 and flows into the tubing.

While the fluid is lifted due to the reciprocation of the plunger inside of the barrel and the opening and closing of the valves 39, 57, the reciprocation of the piston 63 does not lift any fluid. Instead, the piston 63 forces the fluid through one or more pressure drops. Consequently, the operation of the piston 63 adds only slightly to the work performed by the prime mover 26 (FIG. 1).

The orifices 65 are sized relative to the smallest of the valves 39, 57. The orifice should be smaller than the inside diameter of the smallest valve seat. This ensures that the fluid flowing through the orifices 65 will experience a greater pressure drop than when flowing through the valve seats. Thus, if the fluid contains any gas, the gas will be separated by the orifices 65, instead of by a valve seat.

In addition, the orifices 65 can be shaped to cause the desired pressure drop. For example, orifices with sharp edges produce a greater pressure drop than do orifices with round edges.

The valve seat that is at the entry of the compression chamber is of the most interest in sizing or shaping the orifice. This is because as fluid flows through the valve seat to enter the compression chamber in the pump, any gas that becomes separated will locate inside of the compression chamber, with consequences of gas locking or interference.

Figure 4:
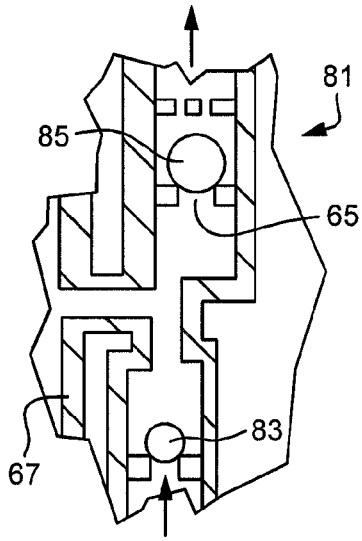
FIG. 4 is a detailed view of a valve arrangement in the pump.

In FIG. 4, there is shown a valve assembly 81 which can be used to supplement the orifice 65. The valve assembly 81 includes two one-way valves. A valve assembly is coupled to an opening on each of the first and second lower chambers 61A, 61B. One valve 83 allows fluid to enter the chamber 61 while the other valve 85 allows fluid to exit the chamber. With the valve arrangement 81, the orifice 65 formed by the seat of the exit valve 85 is sized so as to create a pressure drop to entice the gas to separate from the liquid as fluid is expelled from the respective lower chamber 61A, 61B. The gas is separated from the liquid when the fluid is discharged from the respective chamber 61A, 61B. Thus, the gas is not separated as the fluid flows into the respective lower chamber. Alternatively, each respective chamber 61A, 61B can be provided with an entry orifice having a one-way valve allowing fluid into the chamber and an exit orifice having a one-way valve allowing fluid to exit the chamber.

Figure 5:
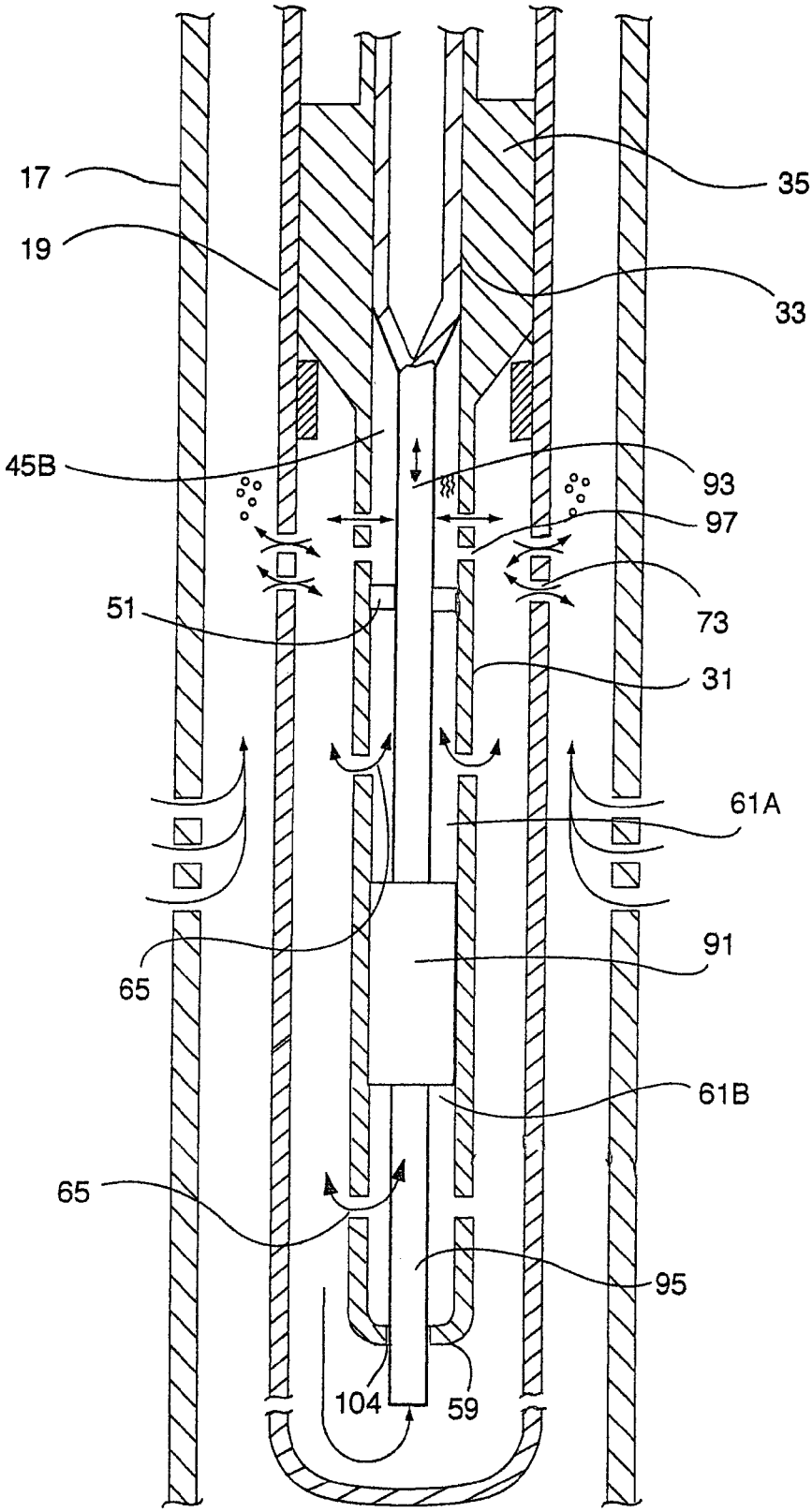
FIG. 5 is a longitudinal cross-sectional view of the lower portion of the downhole pump, in accordance with another embodiment.

FIG. 5 shows another embodiment of the pump. The upper portions of the barrel and plunger of the pump of FIG. 5 are substantially similar to the upper portions of the pump of FIGS. 2A and 2B. Therefore, only the lower portion will be described. The piston 91 and lower rod 93 are hollow so as to allow the flow of fluid therethrough. Depending from the piston 91 is a hollow intake tube 95 which exits the lower end 59 of the barrel 31. The intake tube 95 reciprocates with respect to the lower end of the barrel; consequently, packing or a seal 104 is provided at the junction. The first and second lower chambers 61A, 61B are provided with orifices 65 or valve assemblies 81 as described above.

In operation, the pump of FIG. 5 operates in a manner similar to the pump of FIGS. 2A and 2B. The piston 91 reciprocates up and down in the lower end portion of the barrel 31. The action of the piston 91 draws fluid through the orifices 65, thereby separating the gas in the fluid from the liquid. When the gas is separated from the liquid, the gas flows upwardly and out of the tubing perforations 73. The liquid flows downwardly to the lower end of the intake tube 95. The liquid flows up through intake tube 95, the piston 91, the lower rod 93 and ultimately through the plunger 33. A vent hole 97 is provided in the barrel lower chamber 45B between the packing 51 and the plunger 33 so that the plunger reciprocation will not be inhibited.

Figure 6:
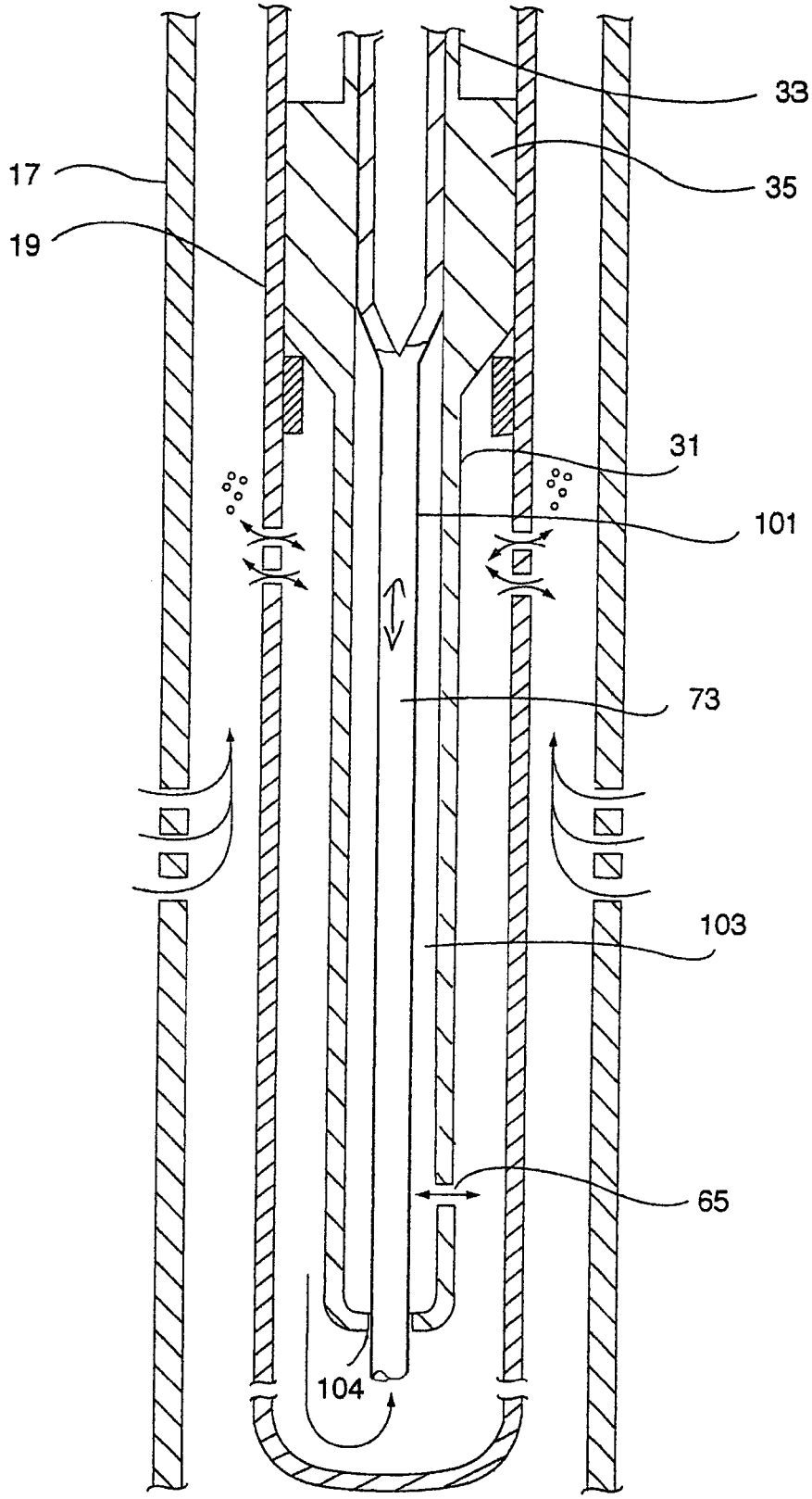
FIG. 6 is a longitudinal cross-sectional view of the lower portion of the downhole pump, in accordance with still another embodiment.

In FIG. 6, still another embodiment of the pump is shown. The upper portions of the pump are substantially similar to the upper portions of the pump shown in FIGS. 2A and 2B. The plunger 33 has a depending hollow intake tube 101 in place of the rod. The intake tube passes through the lower end of the barrel. The chamber 103 between the lower end of the barrel 31 and the plunger 33 has one or more orifices 65 or valves 81 as described above. On the upstroke, fluid enters the chamber 103 by way of the orifices 65, whereas on the downstroke, the fluid is forced from the chamber. Passing the fluid through the orifices 65 subjects the fluid to a pressure drop wherein gas is separated from liquid. The gas exits through the tubing perforations and the liquid enters the plunger at the lower end of the barrel through the intake tube 101.

In the embodiment shown in FIGS. 5 and 6, the intake tube 95, 101 has sufficient length so that it will always remain within the packing 104. In addition, the intake tube 95, 101 can be sufficiently long and depend below the bottom end of the barrel, so that a quiet zone is formed between the bottom end of the intake tube and the bottommost orifice. The quiet zone is discussed in more detail hereinafter in conjunction with FIGS. 7 and 8.

Figure 7:
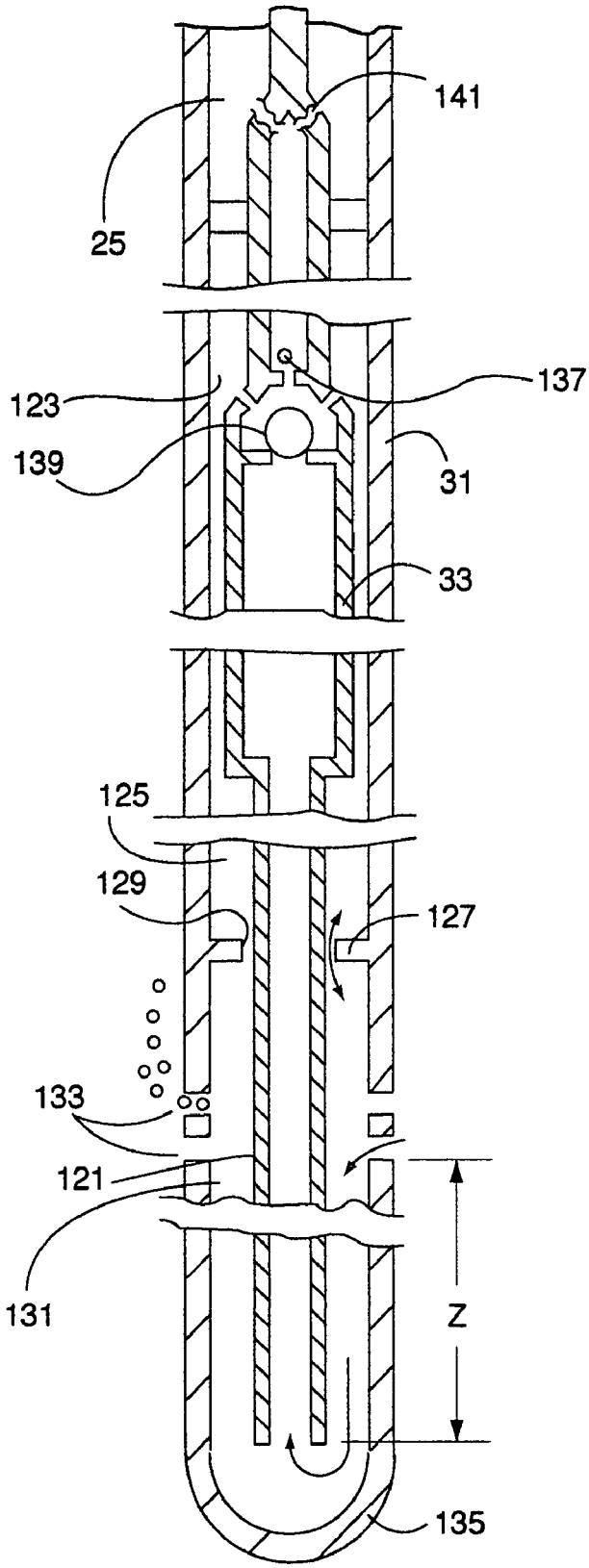
FIG. 7 is a longitudinal cross-sectional view of the downhole pump, in accordance with another embodiment.

FIG. 7 shows the pump in accordance with another embodiment. The plunger 33 has, at its lower end, an intake tube 121. The plunger 33 reciprocates between an upper chamber 123 and an intermediate chamber 125. At the bottom of the intermediate chamber 125 is a wall 127. The wall forms an opening 129 around the intake tube 121. The opening 129 is sized so as to allow fluid to flow therethrough. The transverse cross-sectional area of the opening 129 is sized so as to cause a greater pressure drop to the fluid flowing therethrough, than when the fluid flows through openings (such as valve seats) inside of the pump. Alternatively, the wall 127 need not have a single annular opening, but could have several openings, all sized to create the desired pressure drop.

Below the wall 127 is a bottom chamber 131. In the top portion of the bottom chamber 131 are openings 133 in the wall of the mud anchor 135. The intake tube 121 is open at its bottom end; the bottom end is located below the openings 133. The bottom of the barrel 31 is plugged with the mud anchor 135.

The plunger 33 has upper and lower valves 137, 139, both of which communicate with the upper chamber 123. Above the upper chamber, the plunger opens 141 to the interior of the tubing.

In operation, on the upstroke of the plunger 33 of FIG. 7, fluid is drawn inside of the barrel bottom chamber 131 through the openings 133 and then is drawn into the intermediate, or gas separation, chamber 125 through the opening 129. As the fluid flows through the opening 129 and enters the intermediate chamber, the fluid is subjected to a pressure drop and the gas separates from the liquid.

Also on the upstroke, the lower valve 139 is closed. Fluid (liquid) in the plunger 33 and the intake tube 121 below the lower valve 139 is not displaced relative to the plunger. The upper chamber 123 serves as a compression chamber, forcing the upper valve 137 open. The fluid in the upper chamber 123 flows through the open upper valve 137 into the upper portion of the plunger and out through the openings 141 into the tubing. Furthermore, fluid in the lower chamber 131 below the openings 133 does not move. A "quiet" zone, Z, is formed in the lower chamber between the openings 133 and the bottom of the intake tube 121. The quiet zone is typically between one and two times the volume of the pump.

On the downstroke of the plunger 33, fluid (both liquid and gas) in the intermediate chamber 125 is forced back through the opening 129 and into the lower chamber 131, once again being subjected to a pressure drop and consequently further separating the gas from the liquid. The gas exits the lower chamber 131 through the openings 133. The upper chamber 123 extends, opening the lower valve 139 and drawing fluid from inside the plunger 33 through the lower valve and into the upper chamber. Fluid (liquid) flows from the quiet zone Z of the mud anchor into the intake tube 121. The velocity of the fluid in the quiet zone Z on the downstroke is slow in order to allow gas bubbles to rise to the openings 133. Preferably, the fluid velocity is less than six inches per second.

In the intermediate chamber 125, a gas-to-liquid interface is likely to form. Moving the plunger on the downstroke into this interface will not subject the pump to gas locking or gas interference because the liquid and gas escapes the chamber 125 through the opening 129. Thus, the plunger is offered little resistance, effectively preventing interference and locking.

Figure 8:
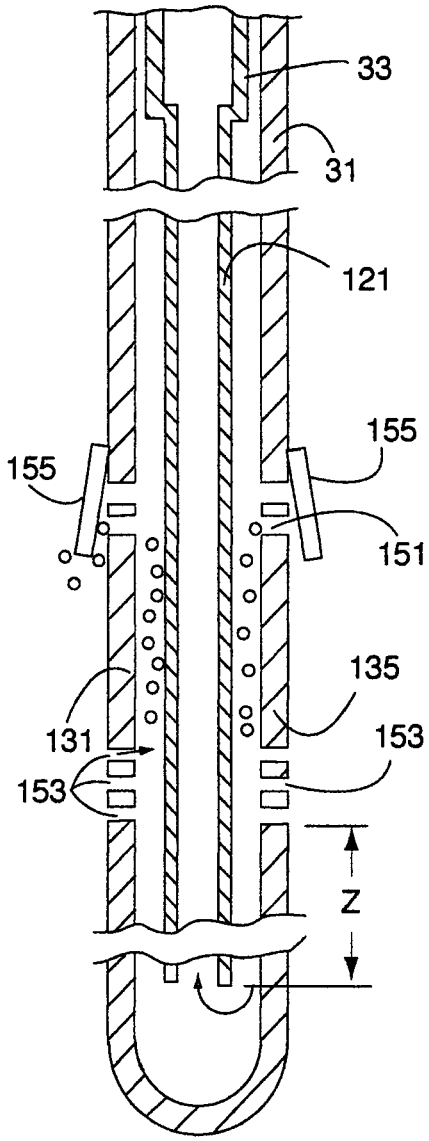
FIG. 8 is a longitudinal cross-sectional view of the lower section of the downhole pump, in accordance with still another embodiment.

FIG. 8 shows the pump in accordance with another embodiment. The mud anchor 135 below the barrel 131 has upper and lower sets 151, 153 of openings. The upper set 151 of openings is the same as the openings 133 described in the pump of FIG. 7, except that a one-way valve 155 covers the openings 151. Fluid can flow from the lower chamber 131 out through the openings 151 and the valves 155. However, fluid cannot flow into the lower chamber through the openings 151 and valves 155. Thus, gas, once discharged from the lower chamber 131, is not drawn back in on the upstroke through the openings 151.

The lower set of openings 153 is located below the upper set of openings 151. The lower set of openings 153 are orifices that are sized to separate gas from the liquid as the fluid flows therethrough, as previously discussed herein. The lower chamber 131 is a gas separation chamber. A quiet zone Z is formed between the bottom of the intake tube 121 and the lower set of openings 153.

In operation, the pump of FIG. 8 draws fluid into the mud anchor through the openings 153 as the plunger moves on the upstroke. The gas is separated from the liquid by passing through the orifices 153. The gas moves upwardly to vent out through the openings 151. As the plunger moves on the downstroke, the liquid is moved into the quiet zone where it resides on the next upstroke.

The valves 155 in FIG. 8 can be flapper type valves, can be of the type shown in FIG. 4, or can be another type. The flapper type valves 155 can open facing downwardly, as shown in FIG. 8, or it can open upwardly (see FIG. 9).

Figure 9:
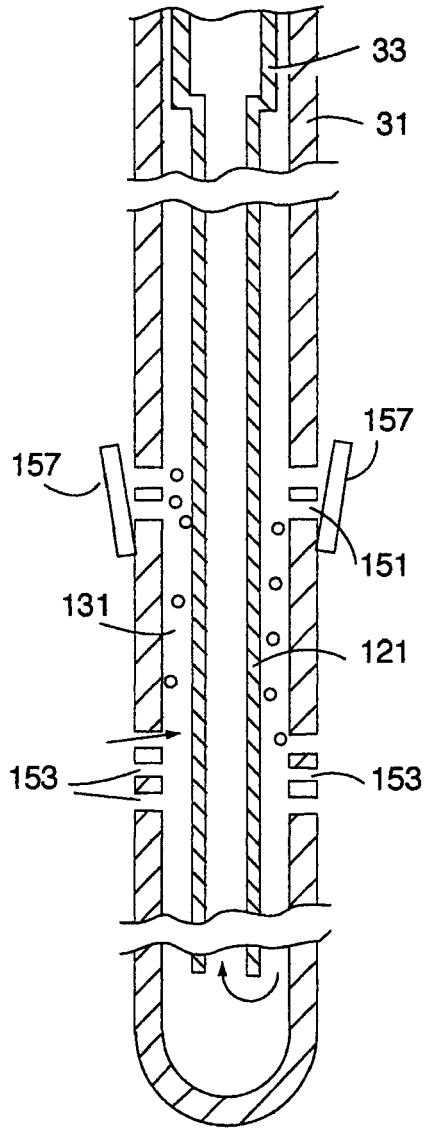
FIG. 9 is a longitudinal cross-sectional view of the lower section of the downhole pump, in accordance with another embodiment.

The pump of FIG. 9 is similar to the pump of FIG. 8, except instead of valves over the upper set of openings 151, there are provided shields 157. The shields 157 are oriented so as to allow gas to vent from the openings and to face upwardly. Thus, any gas that is located outside of the barrel will rise but will be prevented from entering the openings 151 due to deflection of the shields 157.

Figure 10:
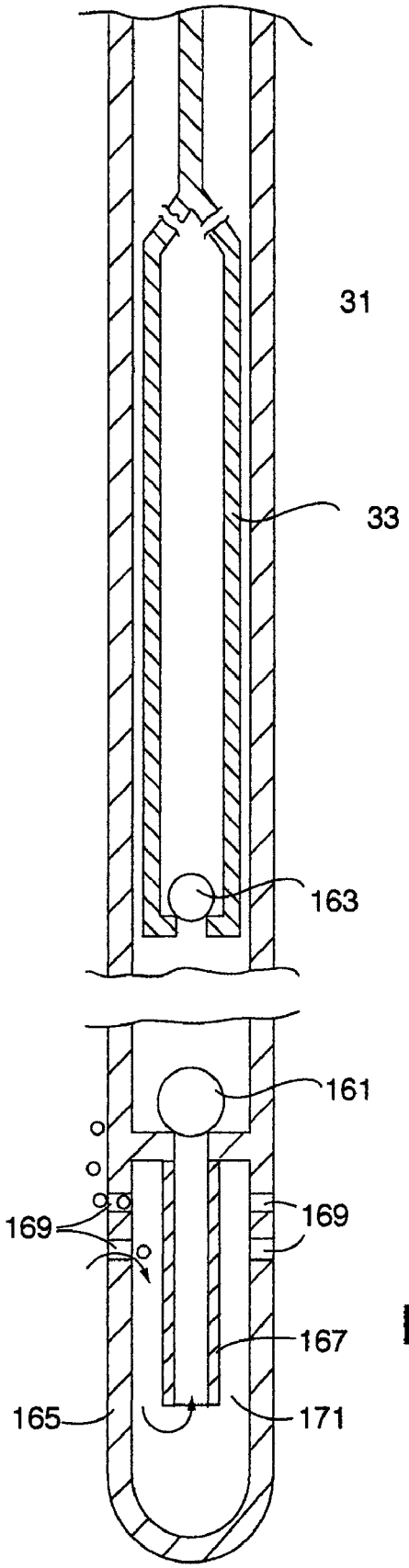
FIG. 10 is a longitudinal cross-sectional view of the downhole pump, shown in accordance with another embodiment.

FIG. 10 shows still another embodiment of the pump. The pump is a standard sucker rod pump having a barrel 31 and a plunger 33, with a standing valve 161 on the barrel and a traveling valve 163 on the plunger. Below the standing valve 161 is a mud anchor 165, which serves as a lower extension of the barrel. A dip tube 167, or intake tube, extends from the standing valve 161 down into the mud anchor 165. The intake tube 167 is stationary with respect to the plunger 33 and extends down inside the mud anchor.

The mud anchor is perforated at its upper end with openings 169. The openings 169 form orifices to subject the fluid to a pressure drop and separate gas from liquid. The openings 169 are sized smaller than the smallest opening in the pump. The pump has a number of openings through which fluid flows, namely the standing valve seat and the traveling valve seat. By locating the smallest openings that the fluid flows through in the mud anchor, the fluid is subjected through the greatest pressure drop upon entering the mud anchor. Thus, any gas in the fluid will separate upon entry into the mud anchor instead of inside of the pump.

The pump operates as normal, with the plunger reciprocating inside of the barrel. On the upstroke, the fluid is drawn into the mud anchor through the openings 169 and into the annulus 171, or gas separation chamber, around the intake tube 167. In the annulus, the gas is separated from the liquid. The fluid is then drawn into the quiet zone, which is between the openings 169 and the bottom of the intake tube 167.

On the downstroke, the plunger descends and the standing valve is closed. The fluid in the quiet zone is not moving wherein gas rises and exits the mud anchor through the openings 169. Fluid (mostly liquid) in the compression chamber flows through the open traveling valve 163 and into the plunger.

On the next upstroke, the fluid in the quiet zone is drawn into the intake tube 167 and the pump.

The present invention subjects fluid to a pressure drop to separate gas from liquid. The gas is allowed to vent to the casing tubing annulus, where it can be captured at the surface, while the liquid enters the pump for lifting to the surface through the tubing. Upon separation, the liquid and gas are intermingled with each other. However, the gas will not reenter solution in the liquid given the relatively short period of time involved (typically several seconds). Much of the gas is vented quickly after the separation. However, some gas bubbles may be carried below the vent openings. The provision of a quiet zone and the moving of the liquid at slow velocities allows gas bubbles to rise to the vent openings.

Thus, with the present invention, the mechanical actuation plunger or piston is used to provide flow of the fluid through one or more orifices and across a pressure drop in order to separate all or some of the gas from liquids. The orifice is sized so as to be smaller than the smallest opening inside of the pump (typically the valve seats). The orifice is located outside of the pump and the gas is provided with an escape path. By preventing the separation of gas from liquid inside of the pump, gas lock and gas interference are avoided. In addition, the pump operates efficiently because the amount of work required to flow the fluid through the orifice is negligible compared to the work required to lift the fluid.

The foregoing disclosure and showings made in the drawings are merely illustrative of the principles of this invention and are not to be interpreted in a limiting sense.

The invention claimed is:

1. A method of separating gas from liquid in fluid pumped by a downhole pump, the pump comprising a compression chamber, comprising the steps of:

a) reciprocating one member of the pump with respect to another member;

b) passing the fluid, by the reciprocation, through an orifice into a second chamber, the orifice being sized so as to subject the fluid to a larger pressure drop than the fluid would be subjected to inside of the pump compression chamber, so as to separate the gas from the liquid;

c) changing the volume of the second chamber during the reciprocation;

d)venting the gas at a location that is above the orifice;

e) allowing the liquid to enter the pump compression chamber at a location that is below the orifice.

2. A method of separating gas from liquid in fluid pumped by a downhole pump, comprising the steps of:

a) reciprocating one member of the pump with respect to another member;

b) passing the fluid, by the reciprocation, through an orifice into a chamber, the orifice being sized so as to subject the fluid to a larger pressure drop than the fluid would be subjected to inside of the pump, so as to separate the gas from the liquid;

c) venting the gas at a location that is above the orifice;

d) allowing the liquid to enter the pump at a location that is below the orifice;

e) wherein the step of passing the fluid, by the reciprocation, through an orifice in the chamber further comprises the step of drawing in the fluid through the orifice in one stroke of the reciprocation and in a subsequent stroke of the reciprocation drawing a liquid in through the entry of the pump.

3. A method of separating gas from liquid in fluid pumped by a downhole pump, comprising the steps of:

a) reciprocating one member of the pump with respect to another member;

b) passing the fluid, by the reciprocation, through an orifice into a chamber, the orifice being sized so as to subject the fluid to a larger pressure drop than the fluid would be subjected to inside of the pump, so as to separate the gas from the liquid;

c) venting the gas at a location that is above the orifice;

d) allowing the liquid to enter the pump at a location that is below the orifice;

e) wherein the step of passing the fluid, by the reciprocation, through an orifice in the chamber further comprises the step of drawing in the fluid through the orifice, and expelling the fluid through the orifice.

4. A method of separating gas from liquid in fluid pumped by a downhole pump, the downhole pump having a plunger and a barrel, and a compression chamber, comprising the steps of:

a) reciprocating one of the plunger or the barrel with respect to the other of the plunger or the barrel;

b) during the reciprocation, alternately expanding and compressing a second chamber formed between the plunger and the barrel;

c) during reciprocation, passing fluid through an orifice that communicates with the second chamber, the orifice being sized so as to subject the fluid to a larger pressure drop than the fluid would be subjected to inside of the pump, so as to separate the gas from the liquid;

d) venting the gas from the barrel at a location that is separate from the orifice;

e) allowing the liquid to enter the plunger compression chamber at a location that is below the vent location.

5. The method of claim 4, further comprising the step of slowing the fluid that is to enter the plunger to a velocity that allows gas bubbles to rise and escape through the vent.

6. The method of claim 1, wherein the step of venting the gas at a location that is above the orifice further comprises the step of venting the gas out of tubing containing the pump.

* * * * *